United States Patent [19]

Yoshiwara et al.

[11] 4,190,887

[45] Feb. 26, 1980

[54] PRESS ROLL PIERCING METHOD

[75] Inventors: Seishiro Yoshiwara; Minoru Kawaharada; Samon Yanagimoto, all of Kitakyushu, Japan

[73] Assignee: Nippon Steel Corporation, Tokyo, Japan

[21] Appl. No.: 878,169

[22] Filed: Feb. 15, 1978

Related U.S. Application Data

[63] Continuation-in-part of Ser. No. 714,960, Aug. 16, 1976, abandoned.

[30] Foreign Application Priority Data

Aug. 22, 1975 [JP] Japan ..... 50-102348

[51] Int. Cl.[2] ..... G06F 15/46; B21B 37/00

[52] U.S. Cl. ..... 364/472; 72/8; 72/209; 364/474

[58] Field of Search ..... 364/469, 472, 474, 118; 72/209, 8–12, 14, 18, 199, DIG. 4

[56] References Cited

U.S. PATENT DOCUMENTS

| | | | |
|---|---|---|---|
| 3,864,951 | 2/1975 | Gulyaev et al. | 72/209 X |
| 3,931,724 | 1/1976 | Berdyansky et al. | 72/209 X |

*Primary Examiner*—Joseph F. Ruggiero

*Attorney, Agent, or Firm*—Wenderoth, Lind & Ponack

[57] ABSTRACT

A press roll piercing method wherein a polygonal billet is pushed in the axial direction thereof between a pair of driven rolling rolls mounted one above the other and a piercing plug is supported in the center of the pass by a mandrel, is improved by selecting a pushing force of a predetermined value which corresponds to a stress above the yield stress of the billet at the starting of the piercing although the actual stress occurring at the starting of the piercing may or may not exceed the yield stress by selecting the pushing speed and/or the peripheral speed of the rolls such that the volume of the billet pushed in per unit time and the volume of the hollow shell discharged from the rolling rolls become substantially equal, whereby the billet is positively gripped by the rolling rolls.

11 Claims, 19 Drawing Figures

PRESS ROLL PIERCING METHOD

This is a continuation-in-part of Ser. No. 714,960 filed Aug. 16, 1976, and now abandoned.

BACKGROUND OF THE INVENTION

The present invention relates to a piercing method for the manufacture of seamless metal pipe from a polygonal billet.

The conventional piercing methods for making seamless metal pipe (for example, seamless steel pipe) include the press piercing method and the inclined roll piercing method, and, recently, there has also come under consideration a press roll piercing method for piercing low priced square or rectangular billets into hollow shells in a single operation. The press roll piercing method is a technique of feeding a square billet in its axial direction into a pair of driven rolling rolls mounted one above the other and of piercing the core portion of the billet while rolling the billet into a round shape, whereby the hollow shell is formed.

In designing and manufacturing a press roll piercing mill, it is necessary to determine what strength and structure the piercing mill proper should have and in this the rolling load is an important factor. Further, in determining the capacity required of the motor for driving the rolls and the strength and structure of the drive power transmitting system, an accurate estimation of the roll torque is required. However, no one has yet proposed a reliable formula for calculating these values. Factors making theoretical calculation difficult are that the press roll piercing method has only recently begun to be studied with a view to practical use and that it is not completely clear what unique deformation conditions occur during the process of piercing the square billet while it is being simultaneously pushed into a circular groove and rolled on its external surface. As a result, the technique of operating the press roll piercing mill is still not well established.

SUMMARY OF THE INVENTION

One object of the present invention is to provide a press roll piercing method making it possible to design an installation of proper size with minimization of loads such as the rolling load and the rolling roll drive torque and the stabilization of such loads.

Another object of the present invention is to provide a press roll piercing method capable of improving the roll biting action and the quality of the pipe, of preventing improper rolling during the piercing operation and of producing deformation without undue stress.

For the purpose of achieving the foregoing objects in a press roll piercing method wherein a polygonal billet is pushed in the axial direction thereof between a pair of driven rolling rolls mounted one above the other while applying a pushing force to the billet and a piercing plug is supported between the rolling rolls, the improved method according to the present invention comprises selecting a pushing force of a predetermined value which corresponds to a stress above the yield stress of the billet at the starting of the piercing although the actual stress occurring at the starting of the piercing may or may not exceed the yield stress; selecting a pushing speed and/or peripheral speed of the rolls having a value such that the volume of the billet pushed in and the volume of the hollow shell discharged from the rolling rolls per unit time become substantially equal, whereby the billet is positively gripped by the rolling rolls.

DESCRIPTION OF THE PREFERRED EMBODIMENTS

Figure 1:
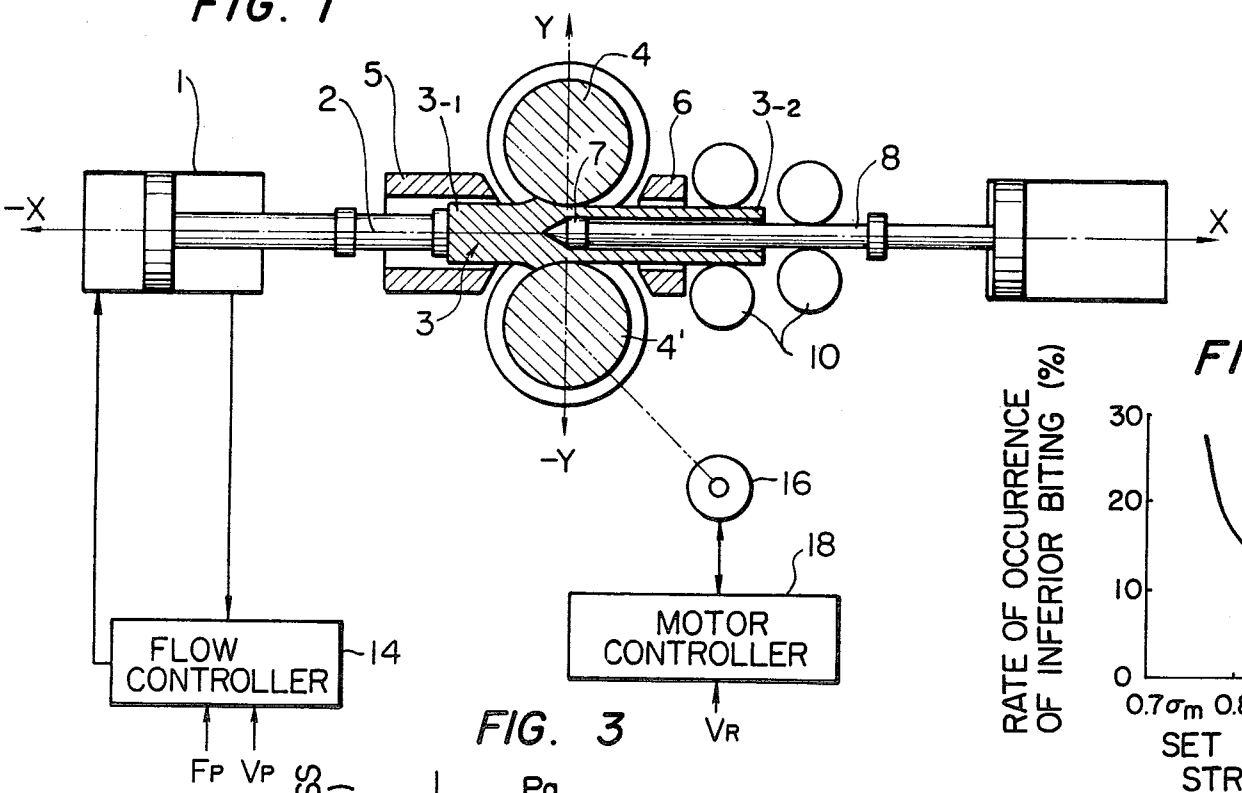
FIG. 1 is a schematic cross sectional view showing one example of a press roll piercing mill for carrying out the method of the present invention.

The press roll piercing method will first be described. As shown in FIG. 1, a square billet (3-1) is pushed between rolls (4) and (4') which are rotated by a motor (16). The billet is pushed by means of a pusher rod 2 driven by a pushing cylinder (1) and an inlet guide 5 and an outlet guide 6 disposed respectively to the fore and rear of the rolls (4) and (4') keep the material (3), namely the square billet (3-1) and a hollow shell (3-2) produced therefrom, on the mill center line X—X.

The pair of rolls (4) and (4') have a circular groove therebetween and a piercing plug (7) is supported in the center of the pass formed by the two rolls (4) and (4') by means of the mandrel (8).

During the rolling operation the square billet (3-1) is caused to advance by the pushing force applied thereto by the pushing cylinder 1 and the advancing force applied thereto by the rolls (4) and (4') so that the core portion of the square billet is pierced by the piercing plug (7) and the billet is expanded into a pipe the outer surface of which is continuously formed into circular shape by the roll grooves. Thus the piercing and pipe-forming operation is almost completed by the time the workpiece reaches the center line of the rolls Y—Y. The thus formed hollow shell (3-2) and the mandrel (8) are supported by the guide rolls (10).

The hydraulic cylinder (1) mentioned above as the means for pushing the billet can be replaced by a motor-driven pinion-rack mechanism if desired.

In the conventional method of operating a press roll piercing mill of the type described in the foregoing, the pusher drives the hydraulic cylinder with a pushing force that is kept constantly below the yield stress of the material. Consequently, the speed of the pusher is not constant but fluctuates between 0 and a given speed depending on the degree of a slip between the rolls and the material. Heretofore, it has been assumed that setting the pushing force above the yield stress of the material would result in crushing of the material and the consequent necessity of discontinuing the piercing operation.

In such conventional methods, the workpiece is often improperly bit by the rolls so that there is a tendency for faulty rolling to occur.

When applied to the press roll piercing method described above, the present invention has the following features.

(1) The pushing force is set at a predetermined value which corresponds to a stress above the yield stress of the billet at the starting of the piercing.

(2) The ratio between the pushing speed and the peripheral speed of the rolls is set to a value such that the volume of the billet to be pushed in per unit time and the volume of the hollow shell to be discharged from the rolling rolls become substantially equal.

(3) Once the biting of the workpiece by the rolls has been accomplished in accordance with (1) and (2) above, the rolling operation is continued with the same pushing force and ratio of speeds.

(4) Or once the biting of the workpiece by the rolls has been accomplished in accordance with (1) and (2) above, the speed ratio is varied and feedback control is carried out to control one factor among the rolling load, the torque, the electric current of the roll motor and the pushing force at a predetermined target value.

The setting of the pushing force will be described first.

The pushing force $F_o$ is set so that pushing stress $J_p$ (pushing force $F_o$/cross sectional area A of the material) exceeds the yield stress $\sigma_m$ (1% of permanent strain) of the material at the time of biting thereof. This means the pressure control value in, for example, the hydraulic cylinder is adjusted to give the relationship $F_o \leqq A\sigma_m$. In other words, assuming that $A\sigma_m = 10{,}000$ kg and the cross sectional area of the piston is 100 $cm^2$, the pressure control value is preadjusted to $10{,}000/100 = 100$ kg/$cm^2$. If the reaction in this case is actually 5,000 kg, the force of 5,000 kg works on the piston rod, and the pressure in the cylinder rises only to 50 kg/$cm^2$.

The reasons for setting the pushing force in this manner are as follows.

In the press roll piercing method, there is a tendency for inferior biting of the material by the rolls to occur frequently. Namely, the rear end face of the billet is pushed by the pusher, and the front end portion of the billet is urged against the piercing plug supported in the center of the rolls, and the core portion of the billet is pierced by the piercing plug due almost completely to the pushing force by the pusher only, and only when the front end portion passes the rolls and leaves the rolls does the advancing force exerted on the workpiece by the rolls begin to reach a constant value. The pushing force necessary for causing the billet and rolls to come into contact over the full angle of bite frequently exceeds the yield stress of the material. There are several reasons for this. One of these is that the temperature drop in the vicinity of the front end portion falls more than that of the mid-portion between the time the billet is extracted from the heating furnace and the time when piercing starts, and as a result, there is a difference in the deformation resistance between the front end portion and the mid-portion. The pushing force necessary for causing complete contact over the angle of bite varies depending on the condition of the rolls, the plug, and other parts of the piercing mill as well as on the condition of the billet itself. Still the force required can be considered to be approximately the yield stress of the material.

Figure 2:
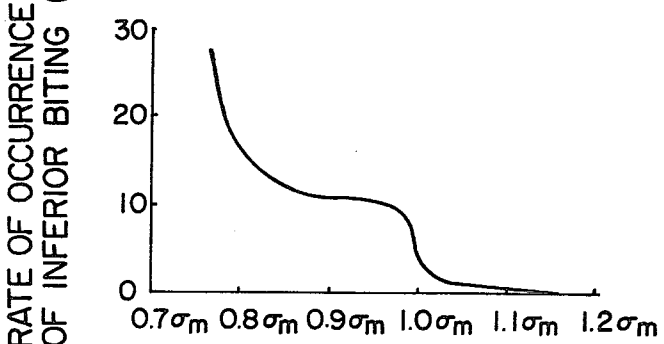
FIG. 2 is a graph showing the relationship between the preset pushing stress values and rates of occurrence of inferior biting of the rolls into the material.

The relationship between the preset value of the pushing stress $\sigma_p$ and the rate of occurrence of inferior biting is shown in FIG. 2. When $\sigma_p \geqq \sigma_m$, the parts of the columnar billet just inward from the two end faces are the first to begin bulging so that, at the loading end, the contact area with the rolls is increased. In the meantime, in the center portion of the billet also begins to bulge, but at a speed lower than that in the vicinity of the faces. This condition continues until the contact over the whole biting angle is completed.

From the foregoing, it can be seen that as the contact area of the billet with the rolling rolls becomes bigger, the drawing force on the billet by the rolls increases both because of the increased contact area and because of the increase in rolling force caused by the increased pushing force.

Thus, gripping of the billet is enhanced both by the increase in drawing force and the increased pushing force so that gripping of the billet by the rolling rolls proceeds smoothly and the billet passes between the rolling rolls while being pierced.

Figure 3:
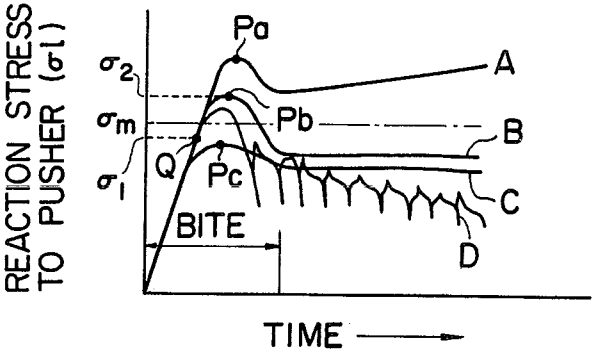
FIG. 3 is a graph showing how the reaction stress to the pusher changes with time.

On the other hand, when $\sigma_p < \sigma_m$, this tendency is not observed, and the inferior biting tends to occur. When the value of the pushing stress $\sigma_p$ is set sufficiently greater than $\sigma_m$, as shown in FIG. 3, a reacting stress $\sigma_l$ (reaction force to the pusher/material cross sectional area) acts on the pusher.

Curve A: The piercing cannot be continued because the pushing speed is too high. The billet jams in front of the rolls during the piercing operation and the piercing is not continued.

This condition is extremely dangerous and entails a danger of breaking the two inlet side guides or the pushing device.

Curve B: This curve tends to occur when the temperature drop in the vicinity of the front end face of the billet is large or under certain condition of the rolls, plug or other parts of the mill.

$\sigma_l$ reaches a peak valve of $P_b$ greater than $\sigma_m$, and after the completion of contact over the whole biting angle, it drops below $\sigma_m$.

If $\sigma_p$ is set at $\sigma_1$ which is a value smaller than $\sigma_m$, $\sigma_l$ can only be elevated to point Q which is equal to $\sigma_1$, and inferior biting action occurs.

(In curve B, bulging occurs in the traverse direction during the period when $\sigma_l \geqq \sigma_m$.)

Curve C: When the temperature drop in the vicinity of the front end face of the billet is small and the settings of the piercing mill are satisfactory, the operation follows the curve C even if $\sigma_p > \sigma_m$, and $\sigma_l$ remains smaller than $\sigma_m$ even at the peak value $P_c$. In this case, $\sigma_p = \sigma_1 < \sigma_m$ is tentatively set from the beginning (provided that $\sigma_1$ is greater than the value at $P_c$), the biting action is carried out successfully, and the curve becomes identical with the curve C.

Curve D: When the pushing speed is too small for the peripheral speed of the rolls, roll slippage occurs intermittently. This condition is to be avoided.

In actual operation, the conditions of curve B and curve C are present in a mixed form, and unless the pushing force is set at a value above the maximum pushing force ($P_a$, $P_b$, $P_c$ points) necessary for the completion of the biting action, the advancement of the material stops before that point.

The setting of the speeds will now be described.

As mentioned above, the pushing speed is set so that the volume of the billet to be pushed in per unit time and the volume of the hollow shell to be discharged per unit time from the rolling rolls become substantially equal. Concretely speaking, the pushing speed is determined by the following formula.

$$V_p = K_1 K_2 (L_1/L_2) V_R \quad (1)$$

or $$V_p/V_R = K_1 K_2 L_1/L_2 \quad (1')$$

wherein, $K_1$ is a correction constant determined by the method of manufacturing the material, and for example, in case of rolled billet, $K_1$ is 1.0, and in case of continuous cast billet, it is properly set at 1.06. But, even in a cast billet to be given particularly large center cavity, $K_1$ does not exceed 1.1. $L_1$ is length of the billet, and $L_2$ is length of the hollow shell as determined on the assumption that the apparent volume of the billet is equal to the apparent volume of the hollow shell.

Accordingly, $K_1(L_1/L_2)$ is the reciprocal of the substantial elongation ratio.

$K_2$ is the ratio of the roll peripheral speed to the discharge speed of the material, and the value of $K_2$ is a constant between 0.95 and 1.20. $V_R$ is the basic roll peripheral speed obtained by the following formula, wherein $V_{MIN}$ is the speed of roll groove bottom, $D_{MIN}$ is the diameter of roll groove bottom, and d is the groove diameter.

$$V_R = V_{MIN}(D_{MIN} + 0.2d)/D_{MIN} \quad (2)$$

The value of $K_2$ is chosen so that neutral points will be present in the contact surface of the billet and the rolls. A concrete method for determining the value of $K_2$ is as follows.

Figure 4:
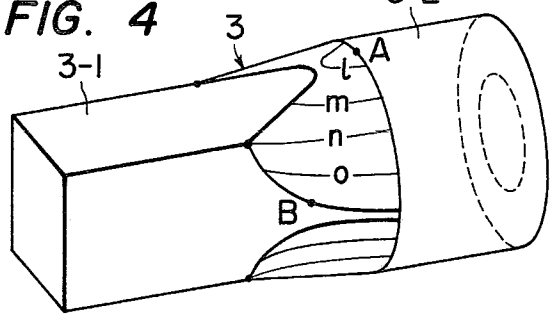
FIG. 4 is an explanatory diagram explaining the shift of neutral lines on the surface of the billet during rolling.

The term "neutral point" denotes a point at which the surface speed of the groove and the advancing speed of the billet are identical. The position of neutral points changes depending on the relative speed of the groove surface to the billet. A line drawn connecting adjacent neutral points on the surface of the billet at a given instant is called a neutral line. Neutral lines take the forms of curves such as l, m, n and o shown in FIG. 4 which represent neutral lines at different relative speed. Point A is the limit beyond which the neutral points cannot exist toward the discharge side of the rolling rolls, and at all points beyond the point A the speed of the material is slower than the groove speed. Point B is the point beyond which neutral points cannot exist toward the loading side of the rolling rolls, and at all the points other than the point B in the contact surface the material speed is faster than the groove speed.

The rolling operation stabilizes when the neutral points are present between the points A and B, namely, when they fall on a neutral line like l, m, n or o. The minimum value $K_{2MIN}$ that can be taken by $K_2$ in case a neutral point is present at the point A can be obtained from the formula $V_1/V_{MIN} = K_1 L_1/L_2$, which prescribes the conditions for speed coincidence at the point A, in conjunction with formulae (1) and (2).

$$K_{2MIN} = (V_p/V_R)(1/K_1)(L_2/L_1) = D_{MIN}/(D_{MIN} + 0.2d) \quad (3)$$

Wherein, $D_{MIN}$ takes substantially a value from 2.0d to 4.0d, and $K_{2MIN}$ at this time is between 0.91 and 0.95. Accordingly, 0.95, which is the lower limit for $K_2$, is a value at which the neutral points can be present over the whole of the practical range, and when the value of $D_{MIN}/d$ becomes smaller, the lower limit can be brought down to about 0.91.

The maximum value $K_{2MAX}$ that $K_2$ can take in case a neutral point is present at the point B can be obtained from the following formula through the formulae (1) and (2) in view of the fact that the maximum diameter portion of the rolls are in contact with the billet at the point B and also that at this point there has not yet been any elongation.

$$K_2 = (D_{MIN} + d)/(D_{MIN} + 0.2d) \quad (4)$$

This gives $K_{2MAX}$ a value ranging from 1.36 to 1.20 where $D_{MIN}$ ranges from 2.0d to 4.0d. Accordingly, the value 1.20 mentioned above as the upper limit for $K_2$ is a value at which neutral points can be present over the whole of the practical range, and the upper limit of the value can be raised if the value of $D_{MIN}/d$ becomes smaller.

The lower and upper limits for the value of $K_2$ are determined to define the range within which the neutral points can be present in the roll contact surface as described in the foregoing. In actual operation, however, the neutral point or neutral line does not exist strictly as a point or line but, because of the phenomenon of sticking between the roll and the material, exists over a certain area. This means that the acceptable range of values of $K_2$ can be somewhat extended. On the other hand, an optimum value of $K_2$ is in the vicinity of $K_2=1.0$. Namely, the speed of the hollow shell at the outlet is almost equal to $V_R$. When importance is attached to prevention of inferior biting, $K_2$ is set at a value bigger than 1.0 and in case emphasis is placed on the prevention of biting flaw, $K_2$ is set at a value smaller than 1.0. In judging whether the value of $K_2$ is proper or not, reference to an electromagnetic oscillogram of the reaction force to the pusher and the rolling load is helpful. For example, the curve A in FIG. 3 shows that the $K_2$ is too large, and it is appropriate in the curves B and C, and it is too small in the curve D.

Thus, when the constant portion of the formula (1) is determined and the value of $V_R$ is substituted into the formula (1), $V_p$ is determined and, in the formula (1'), the value of $V_p/V_R$ is determined.

$V_R$ can be determined at a location such as the portion of maximum roll diameter where the calculation can be easily made, and if the peripheral speed of a roll of any given roll diameter portion is $V'_R$, the constant $K'_2$ corresponding to the $K_2$ for the roll concerned is determined by $K'_2=K_2V_R/V'_R$.

In actual operation, when a difference arises between the $GD_2$ of the pusher system and the $GD^2$ of the roll drive system and a speed unbalance develops between the two due an impact drop or other motor characteristic, it is difficult to keep $V_p/V_R$ perfectly constant from the starting of biting (when the rolls and the material first come into contact) to the completion of biting (when the front end deformed portion completely passes the plane containing the roll shafts). Accordingly, $V_p/V_R$ naturally includes a certain degree of industrial scatter and has a certain range. This range is such that in $V_p/V_R=K_1K_2(L_1/L_2)$, when $K_1$ and $L_1L_2$ are as defined heretofore, $K_2$ does not exceed the range of 0.95–1.20. Namely, fluctuation of $V_p/V_R$ is permissible in the range of $0.95K_1(L_1/L_2)\leqq V_p/V_R\leqq 1.20K_1(L_1/L_2)$. At the time of biting, in order to hold $V_p/V_R$ to a constant value as accurately as possible, favorable control can often be obtained by applying a speed ratio pattern where $V_p/V_R$ is changed during the biting action by taking the difference control characteristics of the pusher and roll drive systems into consideration. Also, as the various rolling characteristics are intrinsically unstable at the time of biting, the measured values of $V_p/V_R$ are found to fluctuate throughout the period from the starting of biting action in the piece to the completion of biting action. Furthermore, the fluctuation pattern differs from piece to piece and therefore too much concern need not be given to bringing the mean value of the actually measured values of $V_p/V_R$ into line with the target value. Rather, it should be remembered that when $V_p/V_R$ is too great, the material is apt to jam in front of the rolls and this leads to various troubles. Therefore, it is better to set $V_p/V_R$ to a value in the vicinity of the lowest values found to give satisfactory results in past operations. For example, it is often advantageous to select a target value of $\overline{X}$ (mean value of measured value) minus $\sigma$ (deviation of measured value). Also, in certain circumstances, $V_p/V_R$ is set at $\overline{X}-\sigma$ at the starting of biting, and is changed to $\overline{X}$ before completion of the biting action. The values of $V_p/V_R$ selected in this manner will not fall beyond the limits of the range defined above. All the foregoing cases are included in the scope of the present invention.

Next, the setting of the pushing force and the pushing speed of the pusher and the setting of the peripheral speed of the rolling rolls are described concretely as follows.

Figure 5:
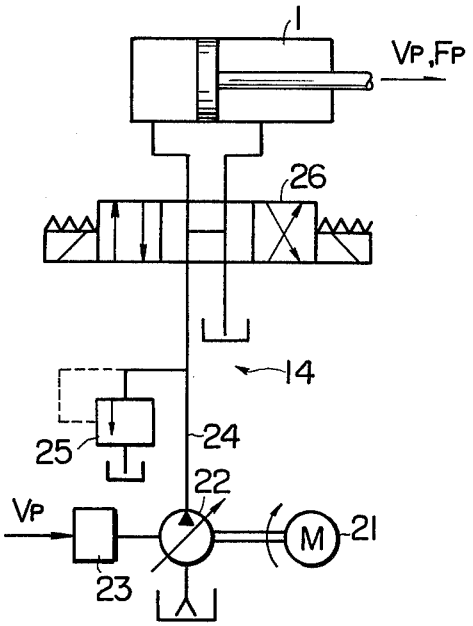
FIG. 5 is a detailed schematic diagram of a power unit shown in FIG. 1.

In FIG. 1, a hydraulic pushing cylinder (1) is driven by the hydraulic pressure from a hydraulic power unit (14) including a cylinder controller. As shown in FIG. 5, the hydraulic power unit (14) is provided with an axial plunger pump (22) driven by a motor (21). As is well known, the axial plunger pump (22) is capable of varying its discharge volume by changing the angle of inclination of the swash plate thereof. The inclination angle of the swash plate is set to the required angle by a pushing speed setter (23), and the pushing speed $V_p$ of the billet is set to a predetermined value. A relief valve (25) is provided on a pipe (24) at the discharge side of the pump, and the pressure setting of the relief valve (25) is a adjusted to set the pushing force of the billet to a predetermined value. Also, a direction changeover valve (26) is provided between the relief valve (25) and the hydraulic cylinder (1), and the operating direction of the hydraulic cylinder, (forward or backward) is selected. Alternatively, the hydraulic power unit (14) may be comprised of a hydraulic pump (a vane pump, for example), a relief valve for pressure control and a flow control valve for adjustment of flowrate.

The peripheral speed of the rolling rolls is set by a motor controller (18) as follows.

Figure 6:
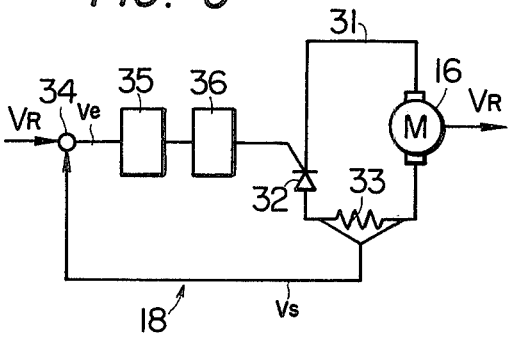
FIG. 6 is a detailed schematic diagram of the motor controller shown in FIG. 1.

FIG. 6 shows the motor controller (18) shown in FIG. 1 in greater detail. The motor controller (18) has an armature circuit (31) for controlling the motor (16) for driving the rolling rolls. The armature circuit (31) is provided with a thyristor (32) whose ignition angle is controlled by an ignition angle control device (36). The setting signal for the peripheral speed of the rolling rolls is inputted to a comparator (34) and is compared with a feedback signal ($V_s$), namely, the voltage drop across the terminals of a shunt (33) in the armature circuit (31). A control operation signal Ve from the comparator (34) is amplified by an operation (35), and then is inputted to the ignition angle control device (36). In the abovementioned circuit, the thyristor (32) is controlled of its ignition angle according to the setting signal for the peripheral speed $V_R$ of the rolling rolls, and as a result, the mean voltage of the armature of the motor (16) is changed, and the peripheral speed of the motor, namely, the peripheral speed of the rolling rolls is controlled to a desired value.

Figure 7:
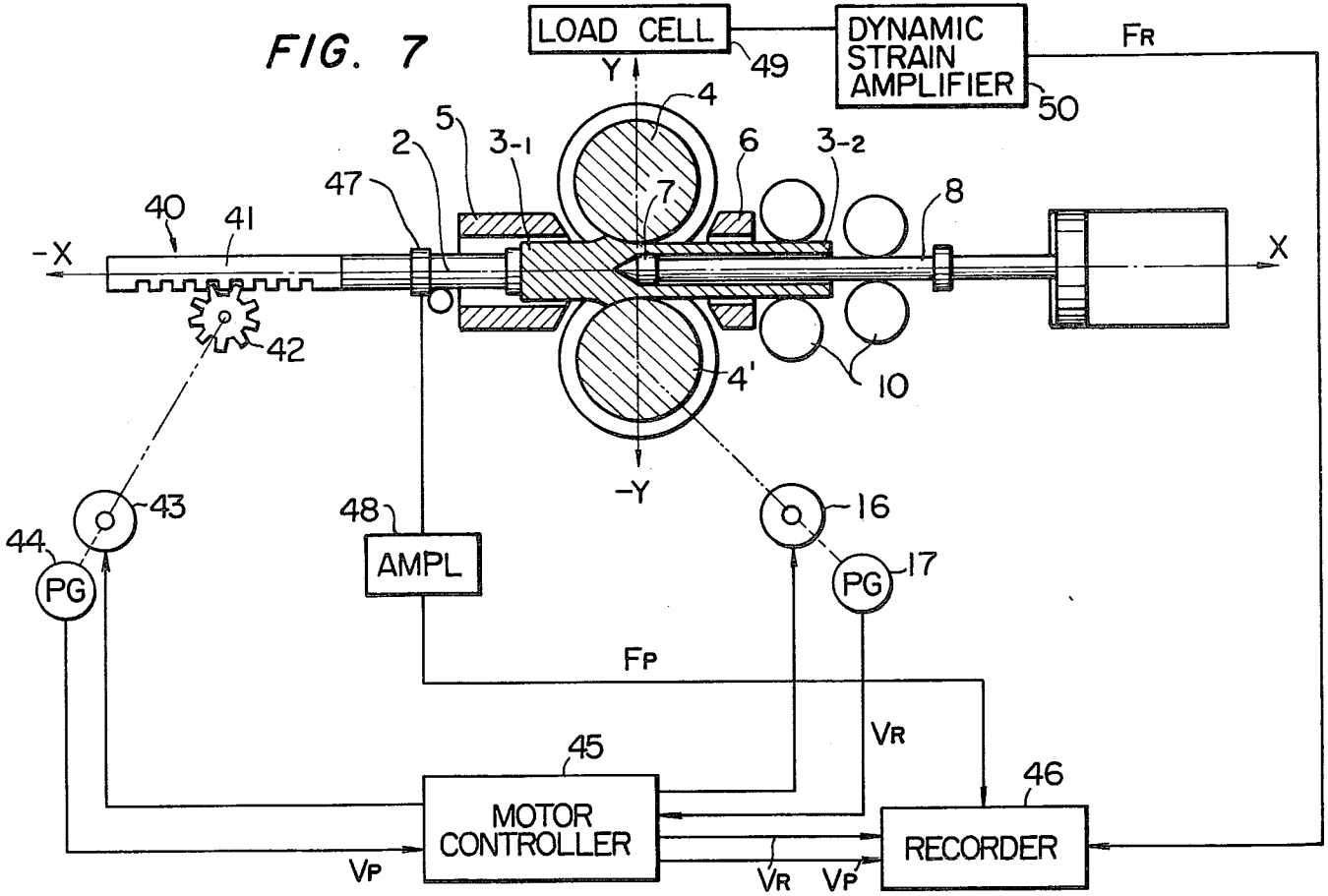
FIG. 7 is a schematic cross sectional view showing one example of a press roll piercing mill employing a motor-driven mechanism for pushing the billet into the rolling rolls.

The foregoing embodiment is constructed by using a hydraulic cylinder as the pusher for pushing the billet, but the pusher is not limited to this type and may be of motor-driven type. FIG. 7 shows one example of a press roll piercing mill provided with a motor-driven pusher.

In FIG. 7, the rolling rolls, plug, and guide are identical with those used in the mill shown in FIG. 1, and the same reference numerals are used to identify like parts. A billet (3) is pushed by a rack (41) meshed with a pinion (42) which is rotatably driven by a DC motor (43). The revolution speeds of the motor (43) for pusher and the motor (46) for rolling rolls are set by the motor controller (45). The motor controller (45) transmits speed control signals to the motors (16) and (43), and at the same time, the controller (45) receives a peripheral speed signal from the speed detector (17). The motor controller (45) is inputted with required information on the pusher speed $V_p$, the roll peripheral speed $V_R$, the speed ratio $V_p/V_R$, the pushing force $F_p$ and a speed pattern $\alpha$. The speed ratio $V_p/V_R$ is determined when either the pusher speed $V_p$ or the roll peripheral speed $V_R$ is determined. The speed pattern $\alpha$ represents a pattern of the timewise change of the speeds of the pusher and rolling rolls. Speed patterns of the two speeds $V_p$ and $V_R$ are set so that the biting action is positively maintained at low speed when the biting action is made while keeping the relationship of the formula (1), and after completion of the biting action, it is accelerated to shorten the rolling time, and at completion of the rolling, it is decelerated whereby the most advantageous speed changes for the piercing operation can be obtained.

Figure 10:
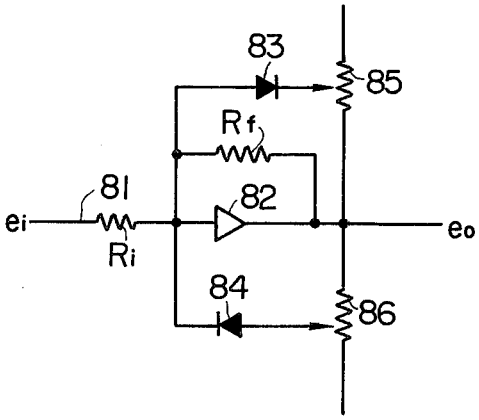
FIG. 10 is a schematic diagram of a pushing force setting circuit.
Figure 8:
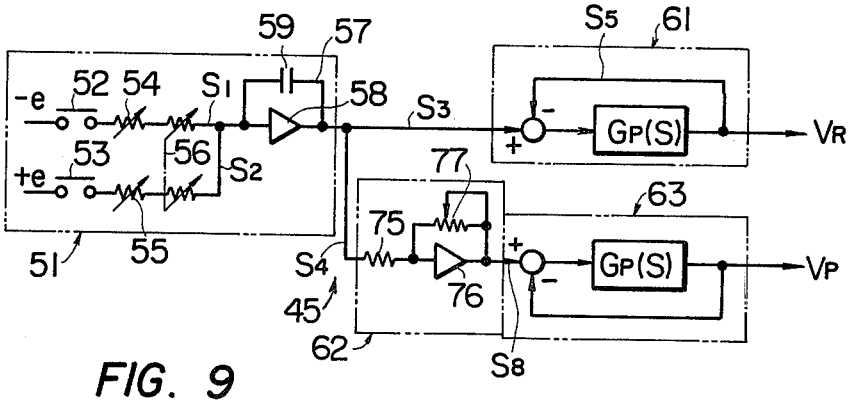
FIG. 8 is a detailed schematic diagram of the motor controller shown in FIG. 7.
Figure 9:
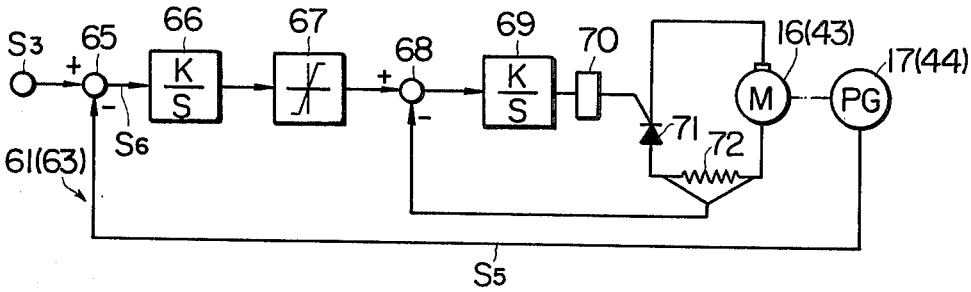
FIG. 9 is a detailed schematic diagram of the speed control circuit shown in FIG. 8.

FIG. 8 to FIG. 10 show the motor controller (45) in detail. FIG. 8 shows a speed commmand unit and the unit is composed of a speed pattern generating circuit (51), speed control circuits (61) and (63) and a speed ratio setting circuit (62).

In the speed pattern generating circuit (51), an acceleration signal (−e) is changed by a variable resistor (54) and a deceleration signal (+e) is changed by a variable resistor (55), and a signal ($S_1$) or signal ($S_2$) is outputted as a speed signal ($S_3$) or ($S_4$) by an integrator (57) comprising an OP-AMP (58) and capacitor (59). When a switch (52) is closed, the pusher and the rolling rolls are accelerated, and when a switch (53) is closed, they are decelerated, and when both switches (52) and (53) are open, they operate at fixed speeds. Also, the acceleration and deceleration of the pusher and the rolling rolls can be carried out at identical rates by ganged variable resistors (56).

The speed signal ($S_3$) from the speed pattern generating circuit (51) is transmitted to the speed control circuit (61) and the speed signal ($S_4$) is transmitted to the speed control circuit (63) by means of the speed ratio setting circuit (62). FIG. 9 shows the speed control circuit (61) in detail. The control circuit for the motor (16) for driving the rolling rolls comprises a comparator (68), an OP-AMP (69), an ignition angle control device (7), a thyristor (71), and a shunt (72) and is identical with the control circuit of FIG. 6. In this speed control circuit (61), the revolution speed of the motor (16) is detected by the speed detector (17), and a speed signal ($S_5$) is made to feedback to the comparator (65). The comparator (65) is inputted with the speed signal ($S_3$) which is compared with the fed-back speed signal ($S_5$) and a deviation signal ($S_6$) representing the deviation between the two signals is transmitted to the comparator (68) through the OP-AMP (66) and a saturation element (67).

The speed signal ($S_4$) from the speed pattern generating circuit (51) is set in the speed ratio setting circuit (62) so that the speed ratio $V_p/V_R$ becomes the required value. The speed ratio setting circuit (62) is comprised of an impact resistor (75), an OP-AMP (76) and a variable feedback resistor (77), and the amplification factor of the OP-AMP (76) is changed by adjusting the feedback resistor (77) to set the speed ratio $V_p/V_R$ to the required value.

A signal ($S_7$) from the speed ratio setting circuit (62) is inputted to the speed control circuit (63) (refer to FIG. 9) which is constructed similarly to the speed control circuit (61), and the revolution speed of the motor (43) is controlled so that the billet is pushed in between the rolling rolls at the required pushing speed.

FIG. 10 shows the circuit of the saturation element (67) provided in the speed control circuit (63) of the pusher. A line (81) is connected to an OP-AMP (82) connected in parallel with a forwardly connected diode (83) and a reversely connected diode (84). The cathode side of the diode (83) is connected to a variable resistor (85) and the anode side of the diode (84) is connected to a variable resistor (86) respectively. The ratio between the input ($e_i$) from the OP-AMP (66) of the preceding stage and the output of the saturation element (67) is determined by the ratio $R_f/R_i$ between a feedback resistor ($R_f$) and an input resistor ($R_i$) of the OP-AMP (82).

The magnitude of the pushing force is adjusted by changing the variable resistor (85) of the saturation element (67). The pushing force $F_p$ satisfies the relationship $F_p \geqq A\sigma m$ where A is the cross sectional area of the material ($mm^2$) and m is the yield stress of the material ($kg/mm_2$). At this time, the required motor output $P_{KW}$ is as follows.

$$P_{KW}=(9.8F_pV_p)/\eta\times10^{-3}\geqq(9.8A\sigma mV_p)/\eta\times10^{-3} \quad \text{(KW)}$$

where $\eta$ denotes an efficiency factor which is generally about 0.9. Namely, the motor capacity is required to be sufficiently greater than a value of the right side of the above formula, and in this case, the variable resistor (85) is adjusted so that the set value of the limit current $I_{MAX}$ becomes as follows provided that the voltage is 1000 V.

$$I_{MAX}\geqq(9.8A\sigma mV_p)/\eta \quad \text{(A)}$$

The force at the time of retracting the pusher can be adjusted by means of the variable resistor (86).

In FIG. 7, a recorder (46) uses a signal from the motor controller (45) to record the pushing speed $V_p$ and the peripheral speed $V_R$ of the rolling rolls, records the pushing force $F_p$ upon receipt of signals from the load cell (47) and the amplifier (48) and also records the rolling load $F_G$ upon receipt of signals from the load cell (49) and the amplifier (50).

The foregoing method can be applied to the whole operation from the starting of the biting action to the completion of rolling, but after the completion of biting action, it is also possible to switch to another method. For example, the set value of the pushing force may be lowered to below the yield stress of the material after the completion of biting action by changing the setting of the variable resistor (85) in FIG. 10 when a motor-driven pusher is used, or by resetting the pressure control valve in the hydraulic cylinder when a hydraulic system is used. In this case, the ratio $V_p/V_R$ cannot be maintained constant, but the danger of damaging the installation is decreased.

In this pushing method, improper rolling is sharply decreased; in case the inlet guide is a container guide, it is decreased to 4.5% and in case the inlet guide is the roller guide, it is decreased to 2.2%. However, the load fluctuation in the piercing operation according to this method is greater than in the conventional method under satisfactory operating conditions and, therefore, a greater allowance for safety must be made than in the designing and manufacturing of a conventional installation. For example, the rolling load and the torque become 1.2 to 2.6 times and 1.1–1.6 times respectively in the vicinity of the rear end portion of the billet as compared with the piercing in the vicinity of the front end portion, and moreover differences occur in the deformation of the pipe, and particularly, an overfill is disadvantageously raised in the vicinity of the rear end portion of the billet.

Thus, the present invention incorporates the concept of stabilizing the load characteristics in a press roll piercing machine at a low level by controlling the relationship among the pushing speed, peripheral speed of the rolls, rolling load, torque, and electric current of the driving motor. When the operation of the mill is so stabilized it becomes possible to design an installation of practical size while preventing improper rolling during the piercing and improving the quality of the pipe by carrying out the deformation without undue stress.

In the piercing method according to the present invention (hereinafter referred to as the high pressure pushing method), the causes of great fluctuation in the load characteristics during the piercing operation result from the fluctuation of the pushing force, the bulging of the material during the piercing (which is accompanied by a fluctuation in the contact area in the roll groove), the pressure distribution, the metal flow, and the difference in the deformation resistance resulting from the temperature difference in the longitudinal direction of the material. This combination of complexly interrelated causes makes forecasting of the total effect of the load characteristics described in the foregoing difficult.

The present inventors have made a detailed study of the relationship between the pushing speed and the load characteristics in the high pressure pushing method wherein the pushing stress is set above the yield stress of the material, and have discovered the preferred conditions described earlier, but even when the operation is conducted under these preferred conditions, there is a limit to how well the variety of causes of changing load can be coped with. Nevertheless, the inventors have succeeded in developing a high precision piercing method which permits operation under stabilized load and results in an improvement in the quality of the pipe produced.

The present invention will now be described more in detail in the following, wherein the relationship between the pushing force before the start of piercing and the pushing speed and the peripheral speed of the roll is set in accordance with the high pressure pushing method described above, and thus improper biting action is avoided and smooth piercing is achieved at the start of operation. Thereafter, the rolling load, roll torque or electric current to the roll driving motor are measured, and the vlaues are adjusted to those which are within the programmed values by performing feedback control to vary either the value of the pushing speed or the peripheral speed of the roll or both.

The reason for setting the pushing force at $\sigma p > \sigma m$ in accordance with the high pressure pushing method is that the pushing speed and the roll peripheral speed can be independently controlled and the prevention of inferior biting action can also be achieved. The start of piercing with the pushing speed according to the formula (1) is carried out because the formula (1) is extremely close to the desired value and also because it can be carried out with a small amount of control.

Figure 11:
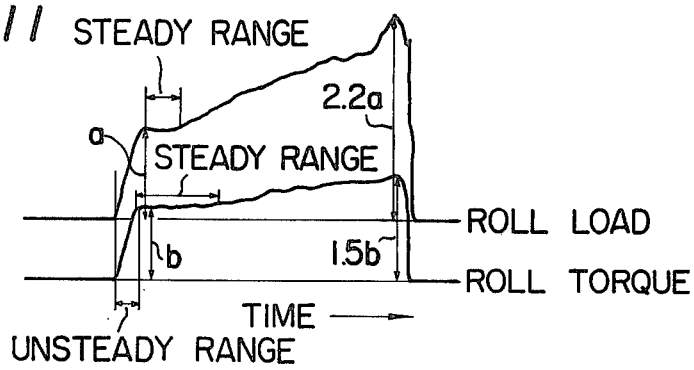
FIG. 11 is an electromagnetic oscillogram showing the results of a press roll piercing operation in which the control of the present invention was not carried out.

The measurement of the rolling load can be carried out with a pressure transducer and dynamic strain meter, or the roll torque can be measured with a strain gauge or a torque transmitter, torque receiver, and dynamic strain meter, and the current is generally measured with an ammeter. The torque is preferably measured not on the roll shaft but between the roll and the reduction gear or between the reduction gear and the motor. In setting the target value for control, it is possible to use the established technique of sampling the value over a given micro unit of time and comparing this value with the previously sampled one. As the least steady part of the operation at the start of piercing has a duration of 0.3–0.5 sec at a pushing speed of 270 mm/sec., the sampling should be begun after about one second has passed from the biting of the billet by the rolls. Among the various characteristics, the one selected for control may be changed from time to time according to the various requirements of the operation. For example, when the main factor to be considered is the strength or rigidity of the rolling mill, a fixed rolling load will be preferred, and when the factor to be considered is the capacity of the roll driving motor or the strength of the drive power transmitting unit, a fixed torque or electric current will be preferred, and if uniform deformation of the material is desired, a fixed rolling load will be required to obtain high precision. Principal load characteristics other than the rolling load, roll torque and electric current of the roll driving motor (hereinafter referred to briefly as rolling load etc.) are the pushing force, pushing speed, roll thrust, mandrel thrust, etc., but the interrelation of these characteristics with the rolling load etc. is not clear, and none of these can be used independently as a single control factor. FIG. 11 shows the time-course change in rolling load and roll torque when the piercing is started with fixed speed pushing. As shown, the rolling load and roll torque have an unsteady period at the time of biting action followed by a steady period, and thereafter, there follows an undulating period during which the load and torque tend to rise and fall. When the rolling load rises, either the pushing speed decreases or the roll peripheral speed increases. A change in the peripheral speed of the roll which is within ±20% is sufficient, and, within the practical operating range, the resulting change in the resistance to deformation has a far smaller influence on the rolling load than the interrelated influence on the rolling load of changes in the peripheral speed of the roll and the pushing speed. However, acceleration of the roll peripheral speed during the piercing operation should be kept to a minimum so that the operation can be carried out with an installation of minimum size. Thus it is preferable to combine increases in the peripheral roll speed with decreases in the pushing speed. When the rolling load is falling, the countermeasure to be taken is the opposite to that for a rising load, and the peripheral speed of the roll is reduced or the peripheral speed of the roll is reduced together with an increase in the pushing speed. If the control is carried out solely by increasing the pushing speed, the load on the pushing device will become much larger and, therefore, care must be taken to limit the increase in pushing speed so as to put an excessive load on the structure and if this mode of control is to be used, it is advisable to design the installation to have the required strength.

If emphasis is placed on the torque or electric current of the roll driving motor (hereinafter referred to as torque), and the torque is rising, $V_p$ and $V_R$ are lowered while $V_R$ is kept constant, and in case it is falling, $V_p$ and $V_R$ are elevated while $V_p/V_R$ is kept constant. The reason for keeping $V_p/V_R$ constant is to make control simpler, and similar to the case of controlling the rolling load, it is possible to change $V_p/V_R$ simultaneously. If $V_R$ is to be changed, sampling of actual $V_R$ values is carried out at a time of no acceleration or deceleration when there is no increase or decrease in the torque.

The foregoing controls are described as examples for the case where the target values are fixed values, but when consideration is given to the facts that the temperature of the square billet falls with the passage of time so that the resistance to deformation increases towards the rear portion thereof and that the amount of rolling and piercing work performed grows larger on account of the expansion of the rolls and the plug, it is, in the interest of obtaining uniform deformation, preferable for the target value to be shifted upwardly, preferably along a specific curve, during the rolling operation. This type of control is encompassed by the present invention. The objects of the invention can be achieved sufficiently when, in the course of the operation, the target value rises within the range of 0–10% with respect to its initial value.

An embodiment of the present invention will be described wherein the experimental conditions are as shown in Table 1.

Table 1

| | |
|---|---|
| Square billet dimension (mm) | 80 $\phi \times 1300$ |
| Piercing dimension (mm) | 91 $\phi \times 22.7 \times 1700$ |
| Kind of steel | Low carbon steel (rolled) |
| Heating temperature (°C.) | 1280 |
| Roll groove dimension (mm) | 91.0 $\phi$ |
| Roll maximum diameter (mm) | 452 $\phi$ |
| Plug diameter (mm) | 45.5 $\phi$ |
| Plug tip position | 40 mm to the inlet side of the roll center |
| Reference roll peripheral speed ($V_R$) (mm/sec) | 300 |
| Initial pushing speed ($V_p$) (mm/sec) | 270 |
| Set pushing force (ton) | 38 |

FIG. 11 is an electromagnetic oscillogram of the rolling load and roll torque when the rolling operation is conducted under the conditions of Table 1 from the beginning to the end of the billet. It will be noted that towards the rear portion where the load becomes bigger, the rolling load is 2.2 times that at the steady portion and the torque is 1.5 times. However, the set pushing speed force is 38 tons, and when this is translated into a set pushing stress, it becomes 6 kg.mm$^2$, which is about three times the yield stress of the material; actually, however, the reaction exceeds the yield stress only slightly. The cross section of the square billet keeps bulging during the piercing operation, and the length of the four sides is increased by 2 to 5 mm.

Figure 12:
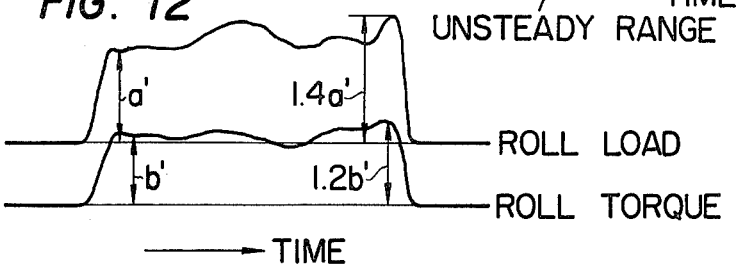
FIG. 12 is an electromagnetic oscillogram showing the results of a press roll piercing operation in which the rolling load was controlled at a desired value by the method of the present invention.
Figure 13:
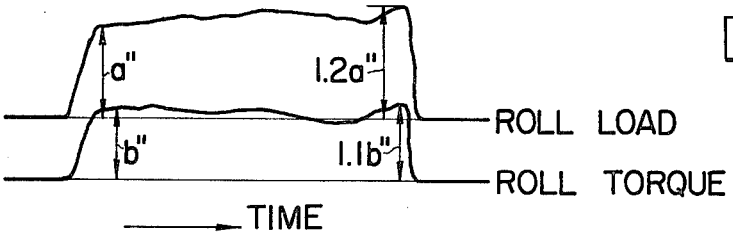
FIG. 13 is an electromagnetic oscillogram showing the results of a press roll piercing operation in which the roll torque was controlled at a desired value by the method of the present invention.

It should be noted that the rolling load changes not only with the elapse of time as mentioned in the foregoing, but also with changes in $V_p/V_R$. Namely, when $V_p/V_R$ becomes greater, the rolling load gradually increases with the elapse of time. Also, when $V_p/V_R$ becomes smaller, the rolling load gradually decreases. When $V_p/V_R$ is too small, the rolling rolls start to vibrate because of the stick-slip between the billet and the rolling rolls or the rolling load is stabilized at a low value by the full surface slip. FIG. 12 shows an embodiment wherein the roll peripheral speed is maintained constant, and the rolling load a′ is caused to approach a target value by controlling the pushing speed. In this mode of operation, the rolling load is kept within 1.4 times the target value, and the roll torque is kept within 1.2 times. FIG. 13 shows an embodiment wherein the roll peripheral speed is maintained constant, and the roll torque b″ is caused to approach a target value by controlling the pushing speed. In this mode of operation, the maximum rolling load is 1.2 times the target value, and the maximum roll torque is less than 1.1 times the target value. Stabilization is attained at a remarkably low level when compared with the embodiment in FIG. 11.

Figure 14:
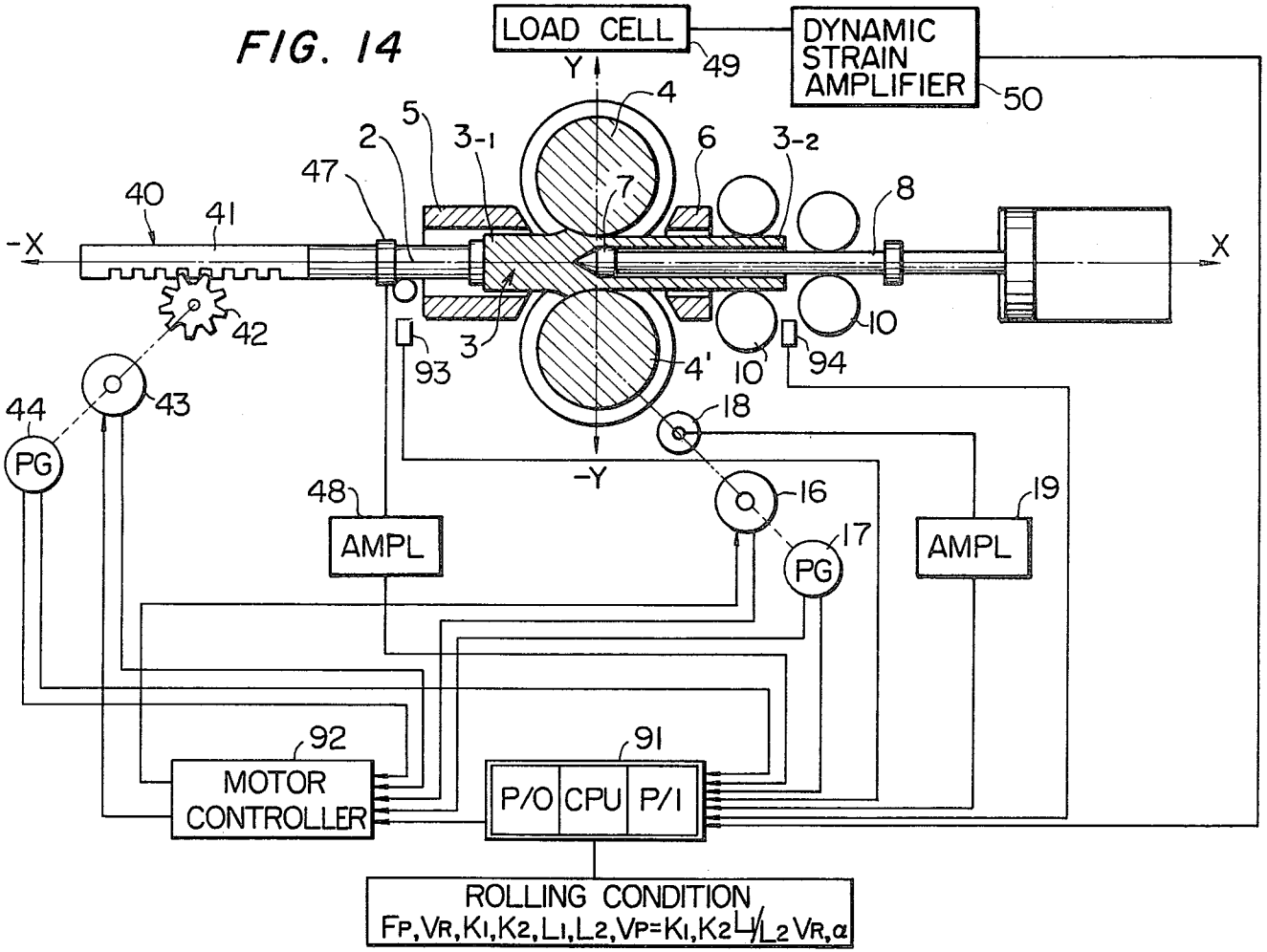
FIG. 14 is a schematic cross sectional view showing the construction of a press roll piercing mill wherein the pushing force on the billet and the peripheral speed of the rolling rolls are adjusted by computer to control the rolling load.

In FIG. 14, a device for controlling the pushing speed and the peripheral speed of the rolling rolls in the manner described in the foregoing is diagrammatically illustrated. Principal portions of the device are entirely same with those of the device shown in FIG. 7, and therefore identical reference numerals are used for like parts.

The pushing force exerted on the billet and the pushing speed of the billet are measured by the load cell (47) and the velocimeter (43) respectively, and the measured values are transmitted to a process control computer (91) through amplifier (48). The signal representing the pushing speed is transmitted to the computer (91) and motor controller (92). Also, the rolling load and the rolling torque are measured by the load cell (49) and the torque meter (18), and the measured values are transmitted to the computer (91) through the amplifiers (50) and (19). The rotating speed of the motor (16) for the rolling rolls is measured by the velocimeter (17), and the signal representing the rotating speed is transmitted to the computer (91) and the motor controller (92). Also, the rolling conditions of the formula (1) for finding the pushing force $F_p$, peripheral speed of the rolling roll $V_R$, and the pushing speed $V_p$ are fed to the computer (91). The speed control of the motor (43) by the motor controller (92) is carried out by the circuit shown in FIG. 9, and the potential differences across the shunts provided in the armature circuits of the motors (16) and (43), namely, the feedback signals are inputted to the motor controller (92).

The computer (91) produces a control signal on the basis of the signals fed to it and this control signal is transmitted to the motor controller (92). The rotating speed of the motor (43) for pusher is controlled by the motor controller (92) to control the pushing speed of the billet and the motor (16) for the rolling rolls is controlled whereby the peripheral speed of the rolling rolls (4) and (4′) is controlled.

In the device shown in FIG. 14, the pushing speed of the billet and/or the peripheral speed of the rolling rolls is controlled by the computer (91) through PI-action or I-action in a direct digital control (DDC) system. As is well known, the direct digital control system is capable of performing complicated operations on numerous variables and of storing various data in its memory. It is therefore capable of easily carrying out feed forward control or sampled data control. The computer (91) comprises a process input controller (P/I) to which the speed signal, load signal and rolling conditions are inputted, a central processing unit (CPU) for performing operations on the signals from the process input controller and a process output controller (P/O) for outputting signals from the CPU to the motor controller (92). This type of computer is similar to an all-purpose computer, and for example, an all-purpose computer of small size such as the IBM SYSTEM 7 may be utilized.

Figure 15:
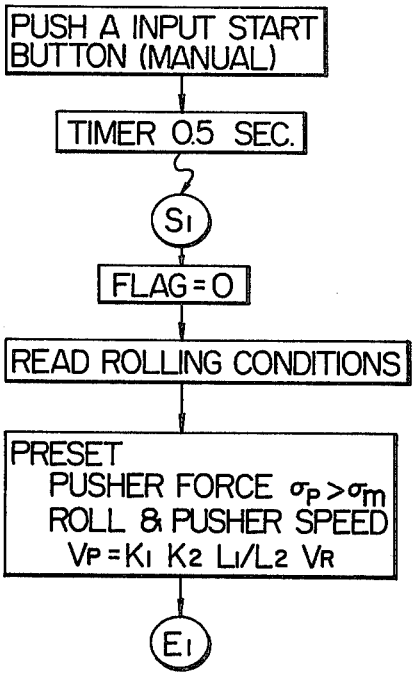
FIG. 15 is a flow chart for setting the rolling conditions for the mill shown in FIG. 14 in a computer.
Figure 16:
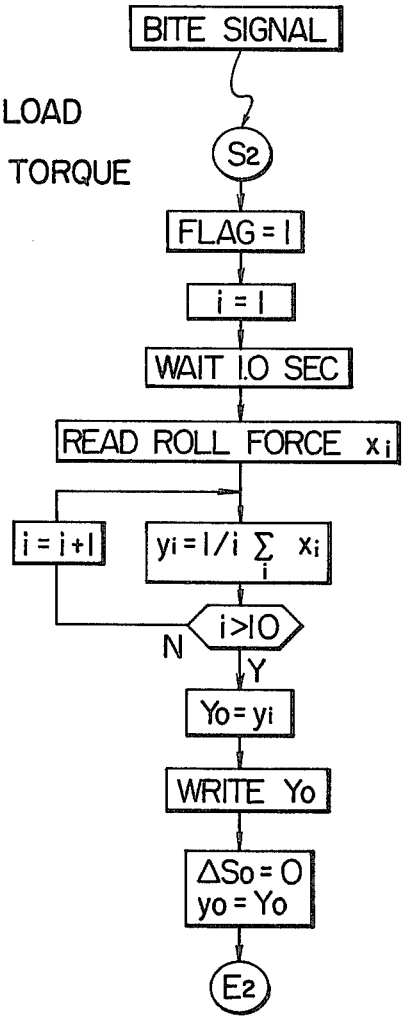
FIG. 16 is a flow chart for the computation of a target value for the rolling load by means of sampling using a computer in accordance with the flow chart of FIG. 14.

FIG. 15 to FIG. 16 show flow charts for processing data in the computer (91). FIG. 15 shows a flow chart for reading of rolling conditions such as pushing force, pushing speed and peripheral speed of the rolling rolls and for making the presettings. When a push button for read disposed on the operating panel of the press roll piercing mill is pressed at the time when the material is not being rolled yet, namely, the time when FLAG=0, the reading of the rolling conditions is started. Namely, a timer provided in the computer (91) operates, and after the elapse of 0.5 second from the pressing of the read push button, the CPU is started to compute the preset values, and then the pushing force, pushing speed and peripheral speed of the rolling rolls are preset according to the result of the computation. These preset values can be changed sufficiently for each lot. The mill is generally stopped at the time of making such a change of preset values but it is also possible to change them between the individual pieces of a lot. These rolling conditions are completely preset before the billet is pushed into the rolling mill and the billet is ready for rolling. When the billet comes to a predetermined position of the rolling line, the pusher (40) advances, and the tip of the billet (3) pushed by the pusher (40) is detected by a hot metal detector (93) just before the rolling rolls (4) and (4'), and the bite signal is transmitted to the computer (91) by the hot metal detector (93). (Refer to FIG. 14). Upon receipt of this bite signal, the computer (91) determines the rolling control signal required to cause the rolling load to approach the steady state as shown in FIG. 11, that is to approach the target value, and upon determining this signal sends it to the motor controller (92).

FIG. 16 shows a flow chart for the operation of the computer (91) in determining the target value on the basis of the rolling load signal from the load cell (refer to FIG. 14). The computer (91) begins to carry out the operation upon receipt of the bite signal and continues to operate during the rolling operation while FLAG=1.

Rolling load $X_i$ is sampled beginning one second after the bite signal, and the average $Y_i$ of the sampled rolling loads is found when the sampling number i reaches 10. The reason for setting the time at one second is that, as mentioned in the foregoing, the rolling load becomes almost constant one second after the start of biting of the billet by the rolls, that is the rolling load enters the steady state about one second following bite. When the average load of the 10 samples has been found, it is outputted as $Y_o$, and the initial value $\Delta S_o$ of the integrated value of the load deviation $\Delta S_i$ which is obtained next is taken as 0, and the initial value $\gamma_o$ of the index mean $\gamma_i$ of the load is taken as $Y_o$. This completes the operation of finding the target value $Y_o$ on the basis of the rolling load signal.

Figure 17:
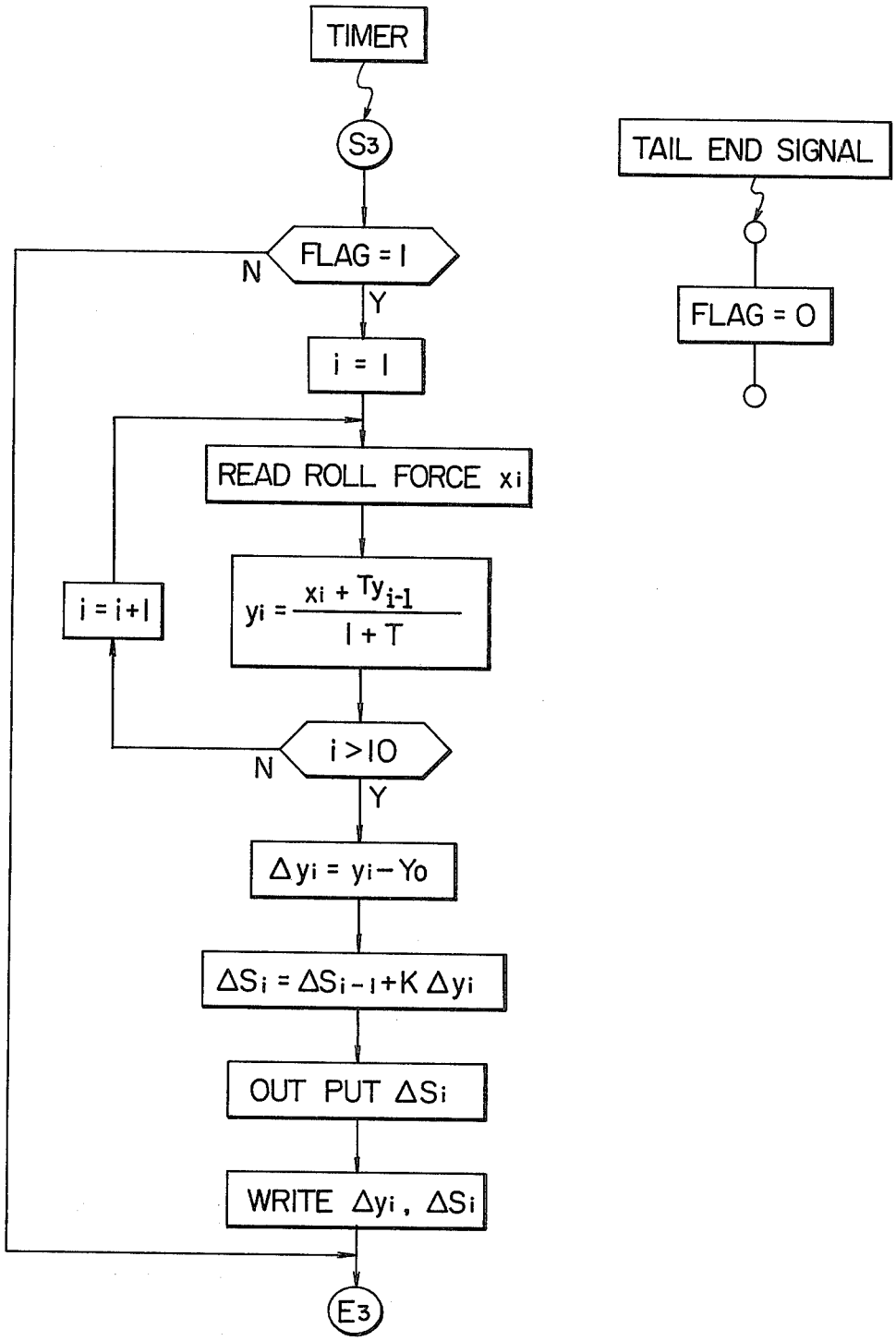
FIG. 17 is a flow chart for calculating the deviation between the actual rolling loads and the target value using a computer in accordance with the flow chart of FIG. 14.

FIG. 17 shows a flow chart for finding the deviation $\Delta Y_i$ between the target value $Y_o$ set as described in the foregoing and the actually measured rolling load value and for determining the OUPUT $\Delta S_i$ from said deviation. The operation is started after the elapse of a predetermined time. First, sample number i is set at 1, and the signal from the load cell (49) is converted and amplified by the dynamic strain amplifier (50), whereupon the rolling load $X_i$ is read. The index mean $Y_i$ of the rolling load is obtained when the sample number i becomes 10. When the index mean load $Y_i$ for 10 samples has been found, the difference $\Delta Y_i$ between the index mean load $Y_i$ and the target value $Y_o$ is found, and then the integrated value $\Delta S_i$ of the difference $\Delta Y_i$ is found, and the integrated value $\Delta S_i$ of the deviation is outputted to the motor controller (92) as the control operation signal. K in the formula for finding $\Delta S_i$ represents a gain. The difference $\Delta Y_i$ and the integrated value $\Delta S_i$ are stored in the memory of the CPU. The order of the operations described in the foregoing are continued during the rolling, namely, while FLAG=1. When the piercing of the billet is over, and the passing of the tail end of the billet is detected by the hot metal detector (94) (refer to FIG. 14) provided at the outlet of the rolling rolls (4) and (4'), FLAG=0, and the computation of the integrated deviation value $\Delta S_i$ is stopped. Namely, the feedback control of the rolling load is stopped.

In FIG. 14–FIG. 17, the subject of control is the rolling load, but as described in FIG. 11 and FIG. 13, the torque of the rolling rolls or the electric current of the roll driving motor can be controlled similarly. Also, the flow charts of FIG. 15 to FIG. 17 can be applied to the case where the pusher is driven by the hydraulic system.

This type of control may be carried out without using a computer but instead by an electric or hydraulic feedback control system.

Figure 18:
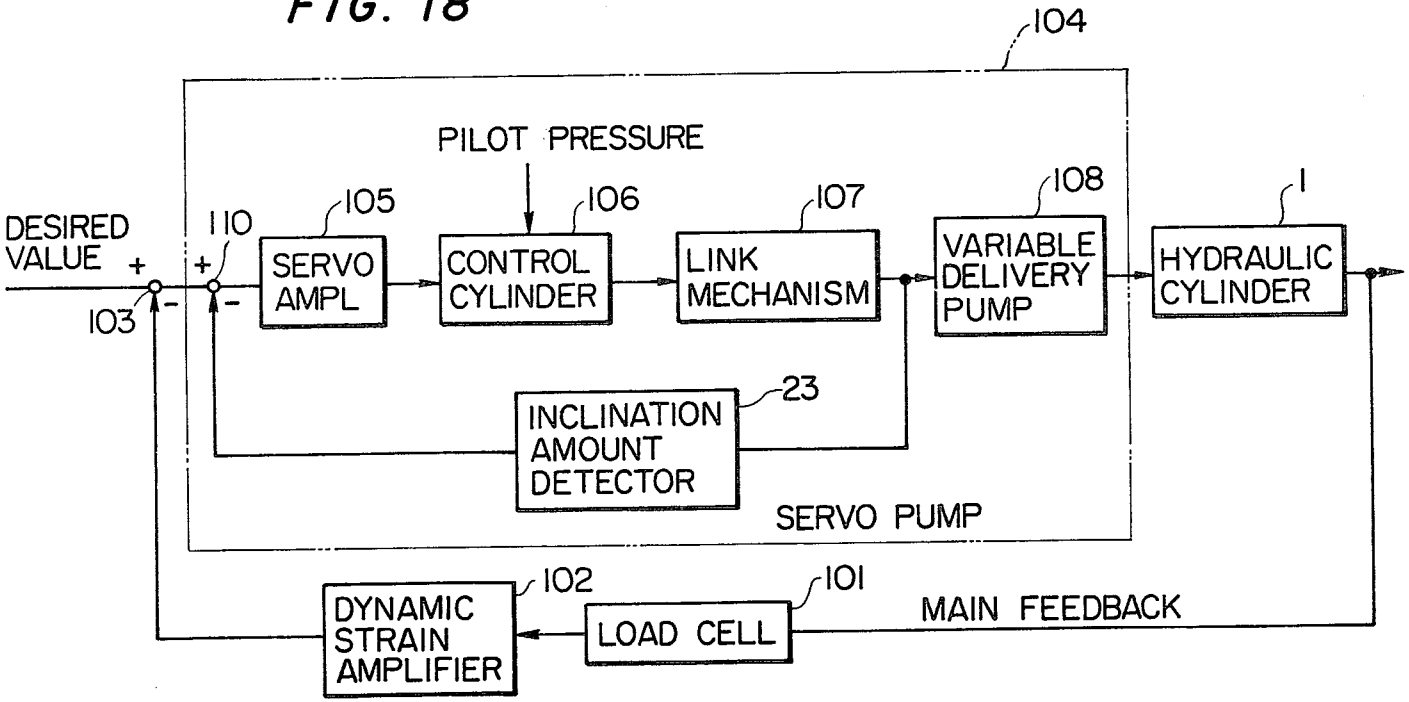
FIG. 18 is a block diagram of a mill wherein the rolling load is controlled by a hydraulic system without employing a computer.

FIG. 18 is a block diagram showing a flow controller for the speed control of the pushing cylinder for pushing material by the hydraulic system, and the piston speed of the hydraulic cylinder (1) is changed by varying the amount of hydraulic fluid discharged by an axial plunger type variable discharge pump (108) by the use of a servo pump of well known type, and the control is carried out so that the roll load approaches the target value.

Namely, the roll load is detected by a load cell (101) similar to the load cell (49) shown in FIG. 7 or FIG. 14, and is amplified by the dynamic strain amplifier (102). The signals from the amplifier (102) are feedback signals and are compared with the desired value in a comparator (103), and the control signals are transmitted to the flow controller (104). In the flow controller (104), the amount of inclination of the link mechanism (107) of the variable delivery pump (108) is detected by the inclination amount detector (23), and the feedback signals from the detector (23) are compared with the control signals in the comparator (110), and a signal proportional to the difference between them is transmitted to the servo amplifier (105). The signal from the servo amplifier (105) is transmitted to the control cylinder (106), and the link mechanism (107) is inclined according to the operation of the control cylinder (106). The amount of discharge of the axial plunger type variable delivery pump (108) changes according to the inclination of the link mechanism (107), and the piston speed of the hydraulic cylinder (1) is changed, and the roll load is controlled so as to coincide with the target value.

Figure 19:
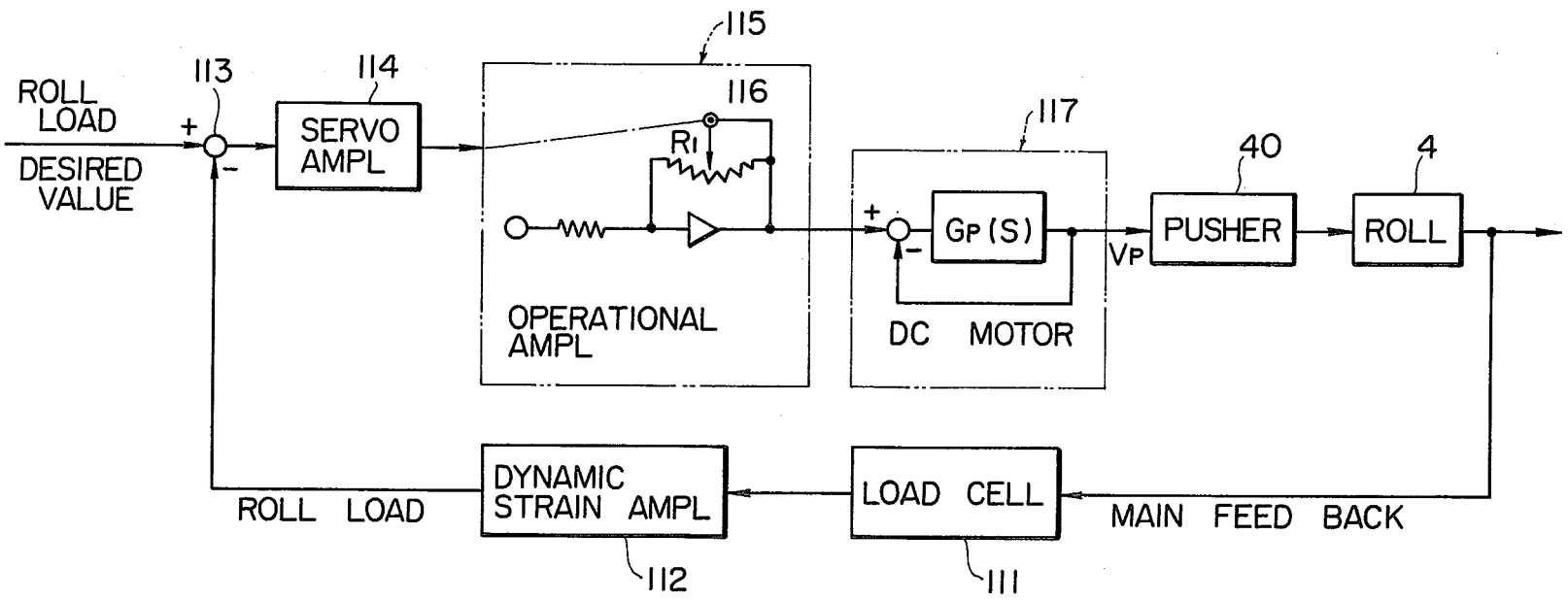
FIG. 19 is a block diagram of the mill wherein the rolling load is controlled by an electric system without employing a computer.

In the case of an electrical system, it is possible to change $V_p$ by, for example, changing the setting of variable resistor (77) shown in FIG. 8 and controlling one factor among the rolling load etc. with respect to the target value. FIG. 19 is a block diagram of an electrical arrangement for performing pusher speed control. The rolling load is detected by the load cell (111), and is amplified by the dynamic strain amplifier (112) and is compared with the target value in the comparator (113), and the deviation is converted to a certain angle of rotation by the servo amplifier (114) so that the setting of the variable resistor (116) of the operational amplifier (115) is varied. The signal from the OP-AMP (113) is transmitted to the speed control circuit (117) constructed similarly to the circuit shown in FIG. 9, and the angular velocity of the DC motor for the pusher included in the circuit is changed. Namely, the pusher (40) advances at speed $V_p$ while the rolling load is determined in relation to $V_R$ as described in connection with FIG. 11. The actual rolling load is furthermore detected by the load cell (111) and subjected to the feedback control acting to reduce the deviation in the comparator (113) to 0.

The present invention can be applied not only to steel but also to other metals that can be plastically deformed. Also the cross-sectional shape of the billet is not limited to a square or a rectangular shape. Moreover, the cross-sectional shape of the hollow shell is not limited to the circular shape but may be oval or a nearly circular shape such as that of a polygon having 80 sides.

What is claimed is:

1. In a press roll piercing method for manufacturing a hollow shell wherein a polygonal metal billet is pushed in the axial direction thereof between a pair of rolling rolls mounted one above the other and having opposed semicircular grooves therein so as to be rolled into a circular or almost circular shape, and the piercing is effected in the core portion of the billet by means of a piercing plug supported between the rolling rolls, the improvement comprising;

setting the pushing force to a predetermined value sufficient to cause a compressive stress above the yielding stress of the polygonal metal billet which is being pushed when the reacting force acts upon the billet;

setting the peripheral speed of the rolling rolls and the pushing speed of the pusher in relation to each other so that the volume per unit time of the hollow shell being discharged from the rolling rolls after the press roll piercing has reached a stable condition after the biting and the volume per unit time of the polygonal metal billet being pushed into the rolling rolls become substantially equal; and causing the billet pushed by the pusher at the pushing speed to be gripped between the rolling rolls rotating at the peripheral speed.

2. A method as set forth in claim 1 wherein the billet is gripped at a pushing speed $V_p$, $$V_p = K_1 K_2 (L_1/L_2) V_R$$

where $K_1$ is a correction constant depending on the method of manufacturing the material of the billet and is from 1.0 to 1.1;

$K_2$ is the ratio of the peripheral speed of the rolls $V_R$ to the outlet speed of the material and is from 0.95 to 1.20;

$L_1$ is the length of the material prior to the rolling;

$L_2$ is the length of the material after the rolling;

$V_R$ is the peripheral speed of the rolls calculated by the following formula:

$$V_R = V_{MIN}(D_{MIN} + 0.2d)/D_{MIN}$$

where $V_{MIN}$ is the peripheral speed of the roll at the bottom portion of the roll groove;

$D_{MIN}$ is the diameter of the roll at the bottom portion of the roll groove;

d is the diameter of the roll groove.

3. A method as set forth in claim 1 wherein the pushing of the billet is continued from the start of the rolling to the completion of the rolling at a speed $V_p$, $$V_p = K_1 K_2 (L_1/L_2) V_R$$

where $K_1$ is a correction constant depending on the method of manufacturing the material of the billet and is from 1.0 to 1.1;

$K_2$ is the ratio of the peripheral speed of the rolls $V_R$ to the outlet speed of the material and is from 0.95 to 1.20;

$L_1$ is the length of the material prior to the rolling;

$L_2$ is the length of the material after the rolling;

$V_R$ is the peripheral speed of the rolls calculated by the following formula:

$$V_R = V_{MIN}(D_{MIN} + 0.2d)/D_{MIN}$$

where $V_{MIN}$ is the peripheral speed of the rolls at the bottom portion of the roll groove;

$D_{MIN}$ is the diameter of the roll at the bottom portion of the roll groove;

d is the diameter of the roll groove.

4. In a press roll piercing method for manufacturing a hollow shell wherein a polygonal metal billet is pushed in the axial direction thereof between a pair of rolling rolls mounted one above the other and having opposed semicircular grooves therein so as to be rolled into a circular or almost circular shape, and the piercing is effected in the core portion of the billet by means of a piercing plug supported between the rolling rolls, the improvement comprising;

setting the pushing force to a predetermined value sufficient to cause a compressive stress above the yielding stress of the polygonal metal billet which is being pushed when the reacting force acts upon the billet;

setting the peripheral speed of the rolling rolls and the pushing speed of the pusher in relation to each other so that the volume per unit time of the hollow shell being discharged from the rolling rolls after the press roll piercing has reached a stable condition after the biting and the volume per unit time of the polygonal metal billet being pushed into the rolling rolls become substantially equal;

causing the billet pushed by the pusher at the pushing speed to be gripped between the rolling rolls rotating at the peripheral speed;

pushing the billet between the rolls at the start of the rolling at a pushing speed $V_p$, $$V_p = K_1 K_2 (L_1/L_2) V_R; \text{ and}$$

carrying out the rolling and piercing of the billet while controlling at least one of the parameters from among the pushing speed and the peripheral speed of the rolling rolls beginning from a minute period of time after the billet is gripped between the rolling rolls so that at least one of the parameters from among the rolling load, the torque of the rolling rolls and the electric current for the roll driving motor approaches a target value.

5. A method as set forth in claim 4 wherein the controlling comprises the steps of rotating the rolling rolls at a predetermined speed, measuring the rolling load of the rolling rolls, and selecting the pushing speed so that the rolling load becomes substantially equal to the target value.

6. A method as set forth in claim 4 wherein the rolling is successively carried out and the rolling of the billet is effected while controlling at least one of the parameters from among the pushing speed and the peripheral speed of the rolling rolls.

7. A method as set forth in claim 6 wherein the controlling comprises the steps of rotating the rolling rolls at a predetermined speed, measuring the rolling load of the rolling rolls, and selecting the pushing speed so that the rolling load becomes substantially equal to the target value.

8. A method as set forth in claim 4 wherein the controlling comprises the steps of pushing the billet in between the rolling rolls at the pushing speed $V_p$, measuring the rolling load of the rolling rolls, and selecting the peripheral speed of the rolling rolls in such a relation that the rolling load becomes substantially equal to the desired value.

9. A method as set forth in claim 4 wherein the controlling comprises the steps of measuring the rolling load of the rolling rolls, and selecting at least one parameter from among the pushing speed and the peripheral speed of the rolling rolls so that the rolling load becomes substantially equal to the target value.

10. A method as set forth in claim 4 wherein the controlling comprises;

pushing the billet between the rolling rolls while maintaining a predetermined ratio between the pushing speed and the peripheral speed of the rolling rolls;

measuring the electric current of the roll driving motor; and maintaining the speed ratio constant while adjusting the peripheral speed of the rolls and the pushing speed so as to cause the electric current to approach the target value.

11. A method as set forth in claim 4 wherein the controlling comprises;

pushing the billet between the rolling rolls while maintaining a predetermined ratio between the pushing speed and the peripheral speed of the rolling rolls;

measuring the torque of the rolling rolls; and maintaining the speed ratio constant while adjusting the peripheral speed of the rolls and the pushing speed so as to cause the torque to approach the target value.

* * * * *

UNITED STATES PATENT AND TRADEMARK OFFICE

CERTIFICATE OF CORRECTION

PATENT NO. : 4,190,887

DATED : February 26, 1980

INVENTOR(S) : SEISHIRO YOSHIWARA et al

It is certified that error appears in the above–identified patent and that said Letters Patent are hereby corrected as shown below:

In Column 13, in Table 1, line 1, righthand side, for "80 ϕ x 1300" read

--80$^{\square}$ x 1300--.

Signed and Sealed this

*Fifth* Day of *January 1982*

[SEAL]

*Attest:*

GERALD J. MOSSINGHOFF

*Attesting Officer*

*Commissioner of Patents and Trademarks*